US010407878B2

(12) United States Patent
Wei

(10) Patent No.: US 10,407,878 B2
(45) Date of Patent: Sep. 10, 2019

(54) SYSTEM AND METHOD FOR DUMPING MATERIAL

(71) Applicant: Caterpillar Inc., Peoria, IL (US)

(72) Inventor: Mo Wei, Dunlap, IL (US)

(73) Assignee: Caterpillar Inc., Deerfield, IL (US)

( * ) Notice: Subject to any disclaimer, the term of this patent is extended or adjusted under 35 U.S.C. 154(b) by 171 days.

(21) Appl. No.: 15/602,210

(22) Filed: May 23, 2017

(65) Prior Publication Data

US 2018/0341267 A1 Nov. 29, 2018

(51) Int. Cl.

| | |
|---|---|
| ***E02F 3/76*** | (2006.01) |
| ***E02F 9/26*** | (2006.01) |
| ***E02F 3/84*** | (2006.01) |
| ***E02F 9/20*** | (2006.01) |

(52) U.S. Cl.

CPC ..... *E02F 9/262* (2013.01); *E02F 3/841* (2013.01); *E02F 9/205* (2013.01); *E02F 9/2037* (2013.01); *E02F 9/2045* (2013.01); *E02F 9/264* (2013.01); *E02F 3/7604* (2013.01)

(58) Field of Classification Search

CPC ..... G05D 1/0219; E02F 3/7604

See application file for complete search history.

(56) References Cited

U.S. PATENT DOCUMENTS

| | | | | |
|---|---|---|---|---|
| 5,801,967 | A | 9/1998 | Henderson et al. | |
| 5,875,854 | A | 3/1999 | Yamamoto et al. | |
| 5,950,141 | A | 9/1999 | Yamamoto et al. | |
| 6,108,949 | A | 8/2000 | Singh et al. | |
| 6,823,616 | B1 | 11/2004 | Gutter et al. | |
| 8,888,403 | B2 | 11/2014 | Atherton | |
| 8,948,981 | B2 | 2/2015 | Wei et al. | |
| 8,983,738 | B2 | 3/2015 | Avitzur et al. | |
| 9,297,147 | B1 * | 3/2016 | Wei | E02F 9/2029 |
| 9,404,239 | B2 | 8/2016 | Wei | |
| 2011/0311342 | A1 * | 12/2011 | Montgomery | G01C 21/04 414/685 |
| 2012/0324853 | A1 * | 12/2012 | Rumpler | A01D 41/00 56/14.6 |
| 2014/0088838 | A1 * | 3/2014 | Furem | B65G 67/04 701/50 |
| 2014/0180444 | A1 | 6/2014 | Edara et al. | |
| 2016/0289922 | A1 | 10/2016 | Wei et al. | |
| 2017/0138016 | A1 * | 5/2017 | Wei | E02F 9/2045 |
| 2018/0210454 | A1 * | 7/2018 | Ready-Campbell | G05D 1/0274 |
| 2018/0245317 | A1 * | 8/2018 | Ready-Campbell | E02F 3/964 |

* cited by examiner

*Primary Examiner* — Jess Whittington

(74) *Attorney, Agent, or Firm* — Leydig, Voit & Mayer, Ltd.

(57) ABSTRACT

A method for depositing a pile of material by a machine at a worksite. The method includes determining, by a controller, a volume of material transported by the machine. The method further includes determining, by the controller, at least one parameter associated with the pile to be formed by the determined volume based on a comparison of the determined volume with a threshold volume and operating the machine to deposit the determined volume to form the pile, on a working surface of the worksite, based on the at least one parameter.

20 Claims, 12 Drawing Sheets

SYSTEM AND METHOD FOR DUMPING MATERIAL

TECHNICAL FIELD

The present disclosure generally relates to a machine for forming a pile of material at a worksite. More particularly, the present disclosure relates to a system and method for controlling spacing and distribution of multiple piles formed by the machine.

BACKGROUND

Dozer machines are used to move material and/or alter work surfaces at a worksite. Such machines may be configured to push material and form piles at a location on the worksite. It is sometimes desired to have a certain number of piles, which are substantially of equal size (for example, similar height) to be positioned at regular intervals along a defined distance. Subsequent to positioning, the piles are then compacted to form a new surface layer, upon which another sequence of piles may be positioned.

However, in operation the dozer may not form piles of equal sizes due to variables such as depressions on the work surface, shedding of material, etc. Accordingly, the piles may be of varying size. Compaction of such piles of varying size may form an uneven surface, which is undesirable.

U.S. Pat. No. 9,404,239 (hereinafter referred to as U.S. Pat. No. 9,404,239) relates to a computer-implemented method for determining a cut location for a machine implement. The method disclosed in U.S. Pat. No. 9,404,239 includes comparing a target cut volume to a projected cut volume associated with each boundary of a selected bin, designating the cut location as the boundary most closely approximating the target cut volume if both of the projected cut volumes at the boundaries are either greater than or less than the target cut volume. The method further includes designating the cut location as an average of the boundaries if the projected cut volumes at the boundaries are greater than and less than the target cut volume.

SUMMARY OF THE INVENTION

In an aspect of the present disclosure, a method for depositing a pile of material, by a machine, at a worksite is disclosed. The method includes determining, by a controller, a volume of material transported by the machine. The method further includes determining, by the controller, at least one parameter associated with the pile to be formed by the determined volume based on a comparison of the determined volume with a threshold volume. Furthermore, the method includes operating the machine to deposit the determined volume to form the pile, on a working surface of the worksite, based on the at least one parameter.

In another aspect of the present disclosure, a material depositing module for a machine operating at a worksite is disclosed. The material depositing module has a controller operatively coupled to the machine. The controller is configured to determine a volume of material transported by the machine. The controller is further configured to compare the determined volume with a threshold volume. Based on the comparison, the controller determines at least one parameter associated with a pile to be formed by the determined volume. Further, the controller is configured to operate the machine to form the pile, on a working surface of the worksite, based on the at least one parameter.

In yet another aspect of the present disclosure, a machine configured to operate at a worksite is disclosed. The machine includes at least one machine sensor and a controller. The at least one machine sensor is configured to generate at least one machine signal. The controller is communicably coupled to the at least one machine sensor and is configured to receive the at least one machine signal from the at least one machine sensor, determine a volume of material transported by the machine based on the at least one machine signal, compare the determined volume with a threshold volume, determine at least one parameter associated with a pile to be formed by the determined volume based on the comparison and generate a machine operation signal to cause the machine to deposit the determined volume to form the pile on a working surface of the worksite based on the at least one parameter.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts.

Figure 1:
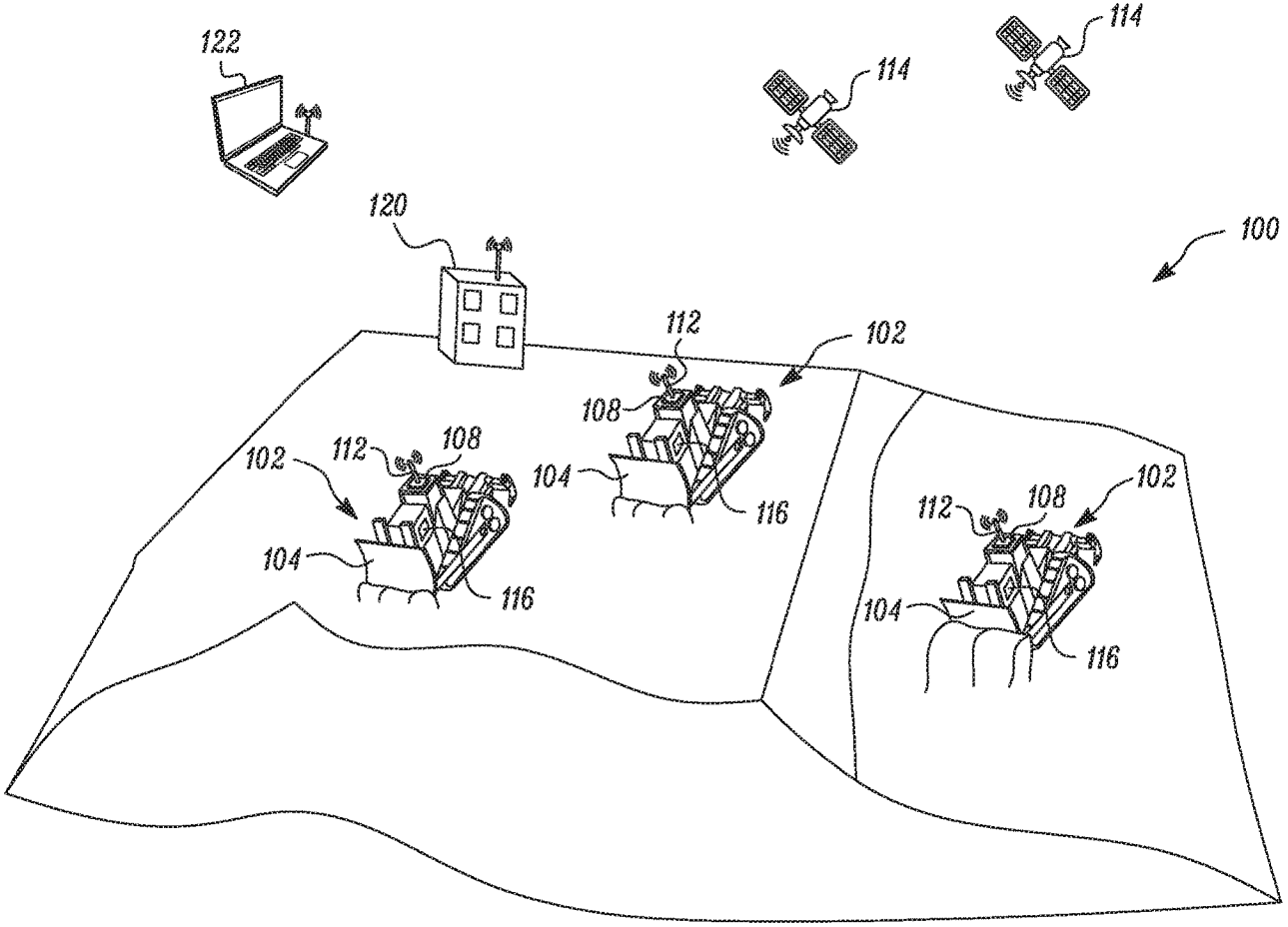
FIG. 1 is a diagrammatic illustration of at least one exemplary machine working at a worksite.
Figure 2:
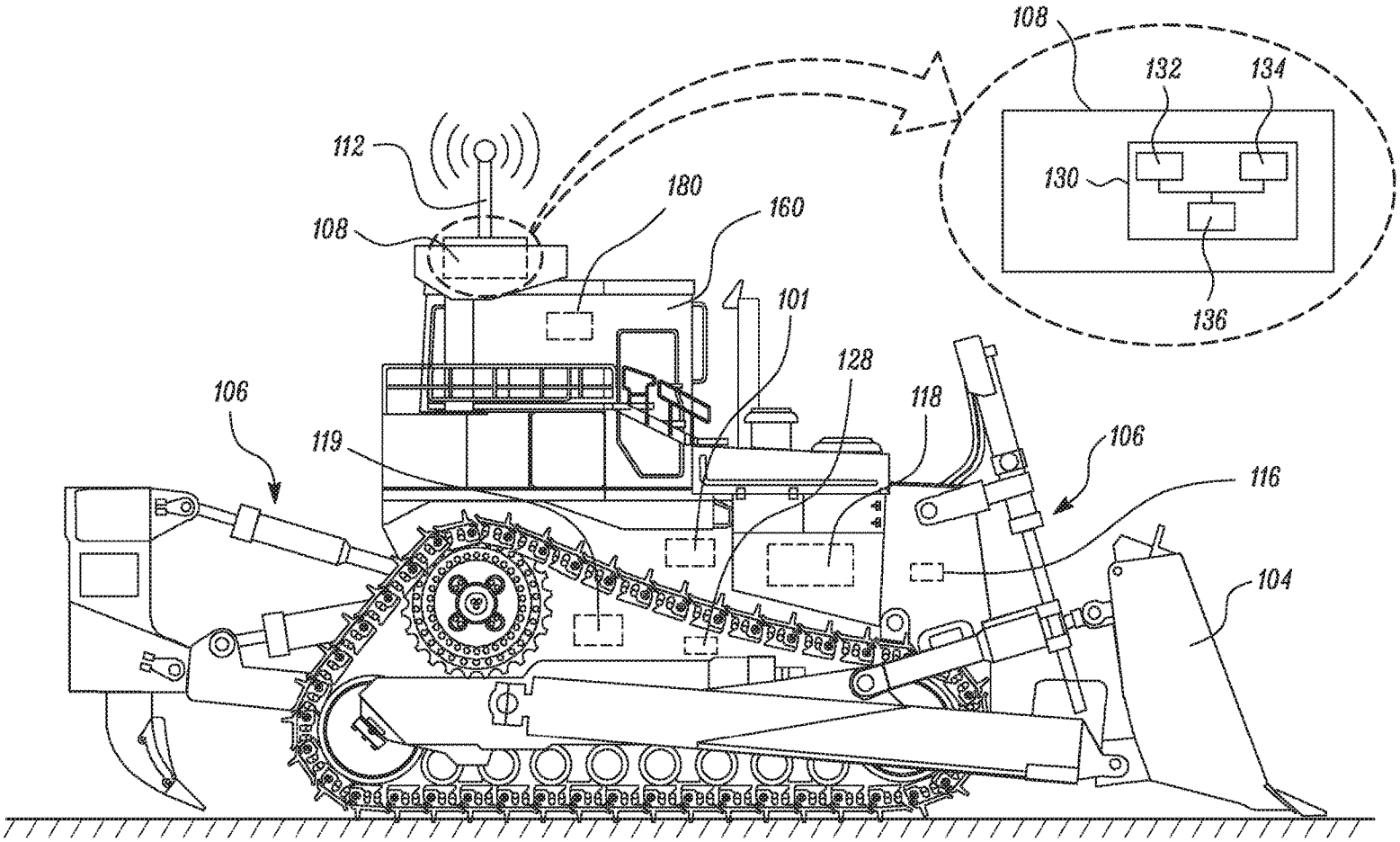
FIG. 2 is a diagrammatic illustration of the at least one machine.

Referring now to FIG. 1, an exemplary worksite 100 is illustrated with one or more machines 102 performing predetermined tasks. The worksite 100 may include, for example, a mine site, a landfill, a quarry, a construction site, or any other type of worksite. The predetermined task may be associated with altering the geography at the worksite 100, such as a dozing operation, a grading operation, a leveling operation, a bulk material removal operation, or any other type of operation that results in geographical modifications within the worksite 100. The machines 102 may be mobile machines configured to perform operations associated with industries related to mining, construction, farming, or any other industry known in the art. The machines 102 depicted in FIG. 1, for example, may embody earth moving machines, such as dozers having blades or other work tools or work implements 104 movable by way of one or more actuators 106 (as shown in FIG. 2). In an embodiment, the machines 102 may be a manned machine. In an alternate embodiment, the machine 102 may be a machine known in the art with various level of autonomy, such as a semi-autonomous machine, a remotely operated machine, or remotely supervised machine.

Each machine 102 may include one or more of a variety of machine sensors. For example, each machine 102 may include a locating device 112 configured to communicate with one or more satellites 114. The one or more satellites 114 may communicate information pertaining to the position and/or orientation of the machines 102 relative to the worksite 100, to the control system 108. Referring to FIG. 2, each machine 102 may additionally include one or more implement sensors 116 configured to track and communicate position and/or orientation information of the work implement 104 to the control system 108. Further, each machine 102 may also include an engine sensor 118 configured to measure the torque produced by an engine 101 of the machine 102. The machine 102 may further include a slip sensor 119 configured to measure the slip factor of the machine 102 i.e. the relative movement of the machine 102 with respect to the ground relative to torque produced by the engine 101 of the machine 102. The machine 102 may also include a perception module 128. The perception module 128 may include at least one perception sensor (not shown). For example, in certain embodiments the perception module 128 may include a light detection and ranging (LIDAR) device. In various other embodiments, the perception module 128 may include perception sensors such as RADAR (radio detection and ranging) device, a stereo camera, a monocular camera, or another device known in the art.

The perception module 128 is configured to generate perception data of the worksite 100. The perception data obtained from the perception module 128 may be used to determine the terrain and geometrical properties of the worksite 100. The perception data along with position co-ordinates obtained from a position detection device may be used to generate a terrain map for the worksite 100 including identifying the terrain features of the worksite 100, such as a crest, a trough, a wall, spill pile, cuttings pile, high fidelity ground, etc. The position detection device may be any one or a combination of a Global Positioning System (GPS), a Global Navigation Satellite System, a Pseudolite/Pseudo-Satellite, any other Satellite Navigation System, an Inertial Navigation System or any other known position detection system known in the art.

The overall operations of the machines 102 and the work implements 104 within the worksite 100 may be managed by a control system 108 present in the one or more machines 102. The control system 108 may be at least partially in communication with the machines 102. The control system 108 may be configured to receive relevant machine information from the one or more of the variety of machine sensors (i.e. the locating device 112, the implement sensors 116, the engine sensor 118, the slip sensor 119 and the perception module 128).

Referring again to FIG. 1, the control system 108 may be implemented in any number of different arrangements. For example, the control system 108 may be at least partially implemented at a command center 120 situated locally or remotely relative to the worksite 100 with sufficient means for communicating with the machines 102, for example, via satellites 114, or the like. Additionally or alternatively, the control system 108 may be implemented using one or more computing devices 122 with means for communicating with one or more of the machines 102 or one or more command centers 120 that may be locally and/or remotely situated relative to the worksite 100. Other suitable modes of implementing the control system 108 are possible and will be understood by those of ordinary skill in the art. Using any of the foregoing arrangements, the control system 108 may generally be configured to monitor the positions of the machines 102 and/or work implements 104 relative to the worksite 100 and a predetermined target operation.

The control system 108 includes a material depositing module 130, as illustrated in FIG. 2. The material depositing module 130 includes a controller 132, a memory 134, and a communication device 136.

The controller 132 may be configured to operate according to one or more algorithms. The controller 132 may include any one or more of a processor, a microprocessor, a microcontroller, or any other suitable means for executing instructions/algorithms/computations. The algorithms/instructions may be retrievably stored within the memory 134. The memory 134 may be provided on-board the controller 132 or external to the controller 132. The memory 134 may include non-transitory computer-readable medium or memory, such as a disc drive, flash drive, optical memory, read-only memory (ROM), or the like.

The controller 132 may be operably coupled to the communication device 136. The communication device 136 facilitates as a means to communicate with one or more of the machines 102, and provides information pertaining to the position and/or orientation of the machines 102 and the work implement 104, for example, via satellites 114, or any other suitable means of communication, to the controller 132.

The controller 132 is operably coupled to the machine 102. The controller 132 is configured to provide instructions for controlling the machines 102 and/or work implement 104 in an efficient manner in executing the target operation. For example, the controller 132 may be configured to generate signals to operate the one or more machines 102 to excavate areas of the worksite 100 according to one or more excavation plans. More specifically, the controller 132 of the machine 102 may be configured to determine a location, size, and shape of a plurality of piles to be deposited onto an intended working surface 124 (as illustrated in FIG. 3) of the worksite 100 along a plurality of spaced apart locations.

Figure 3:
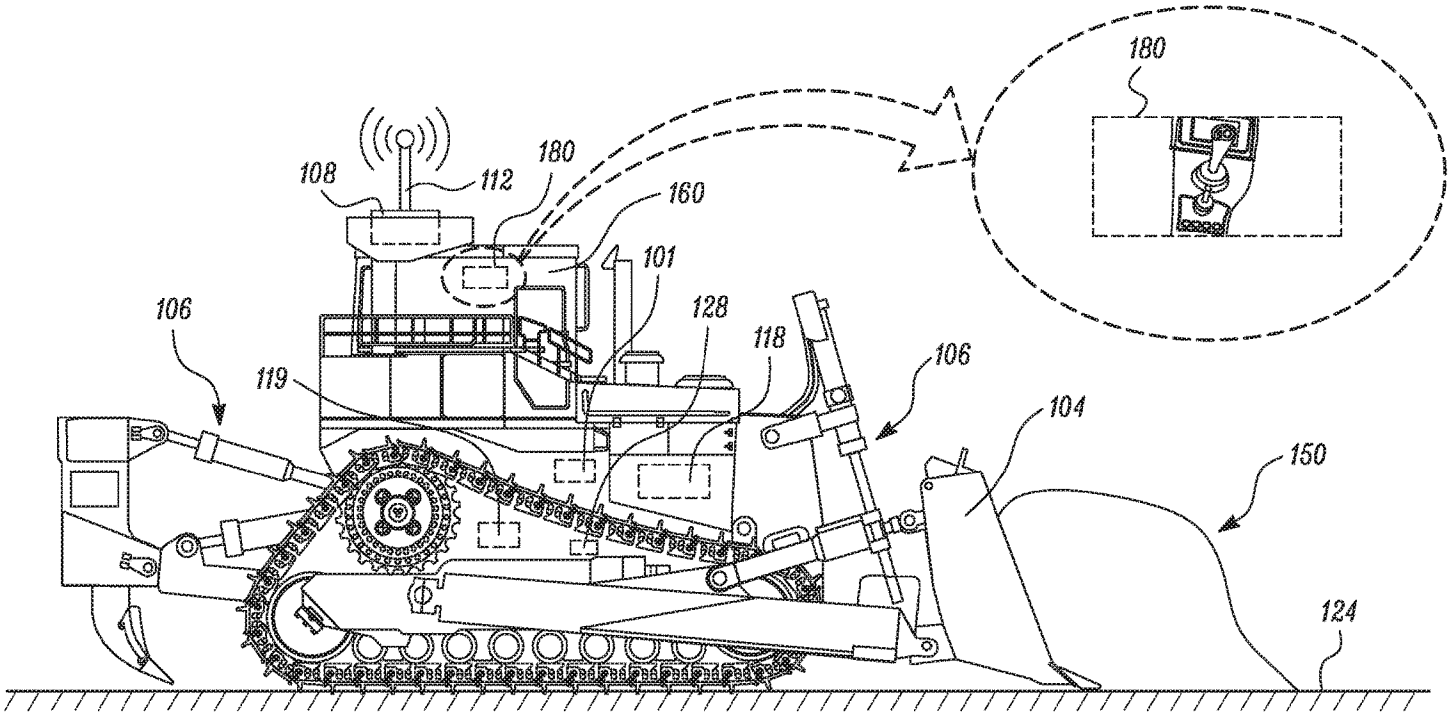
FIG. 3 illustrates a work implement of the machine transporting a threshold volume of material.
Figure 4:
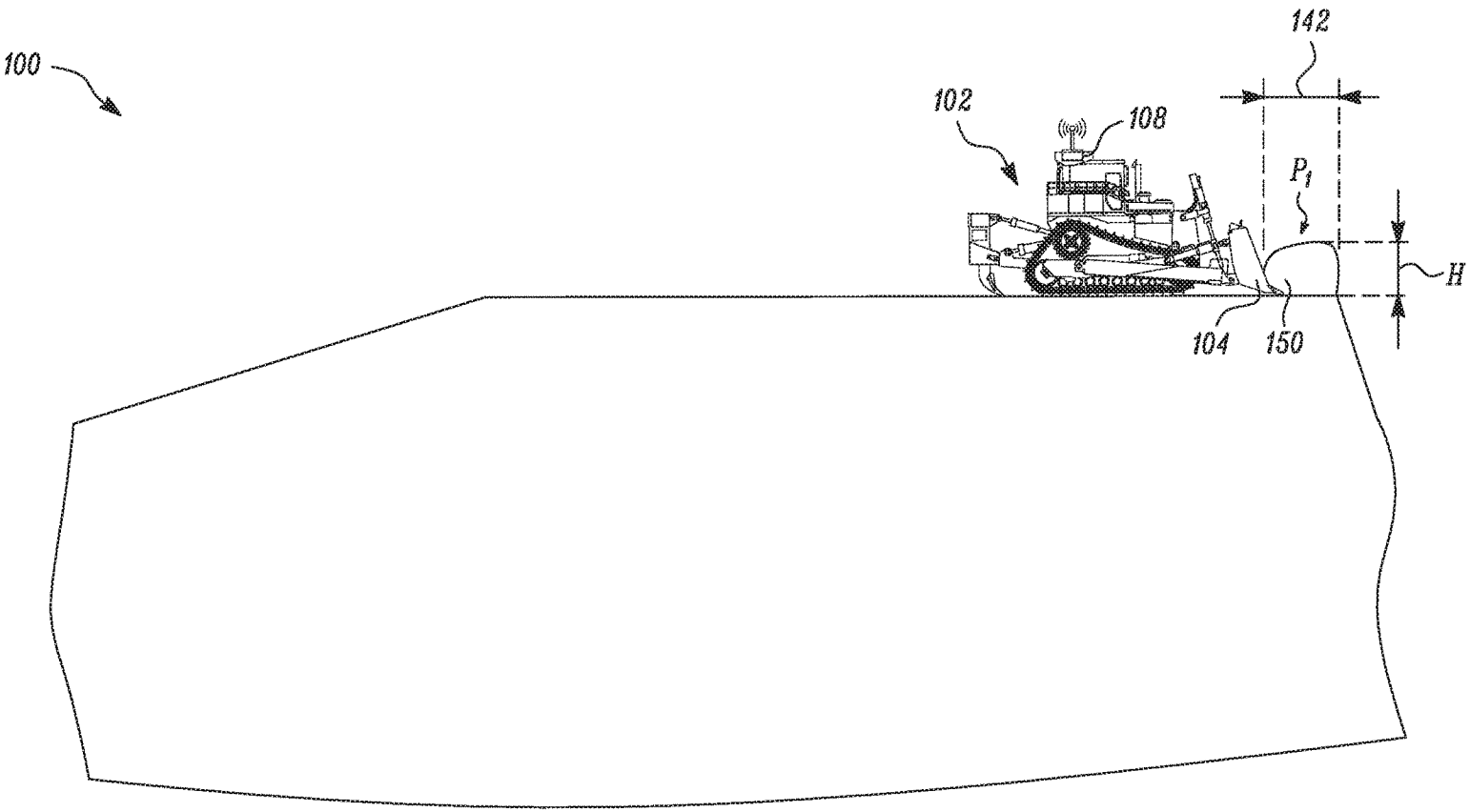
FIG. 4 illustrates the machine depositing the threshold volume of material on a deposit area to form a pile, in accordance with an embodiment of the present disclosure.
Figure 5:
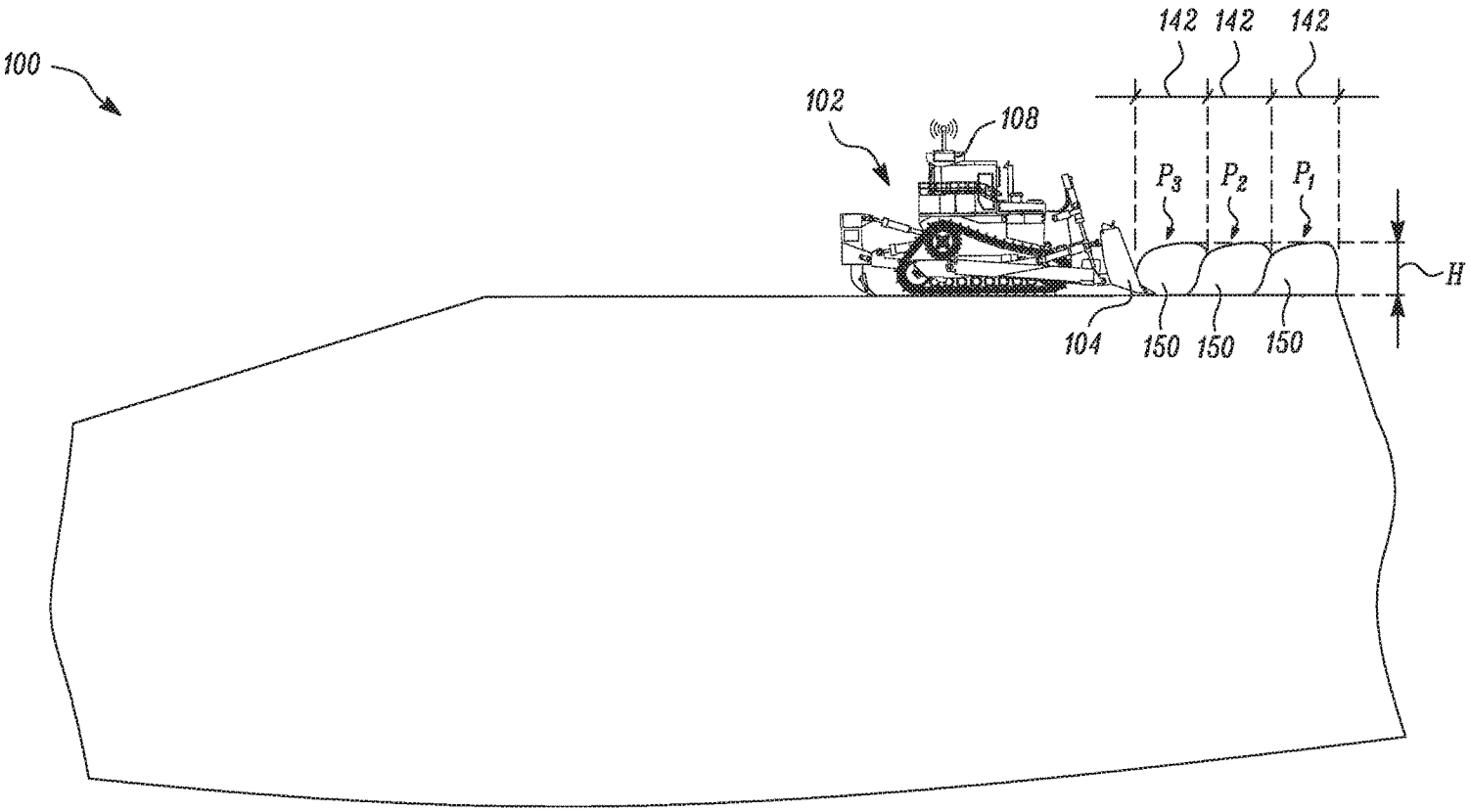
FIG. 5 illustrates the machine depositing the threshold volume of material on plurality of deposit areas to form plurality of piles, in accordance with an embodiment of the present disclosure.

In the embodiment illustrated, the material depositing module 130 is configured to generate a signal to activate the machine 102 to form a plurality of piles equally spaced apart from each other, as illustrated in exemplary illustrations of FIG. 3, FIG. 4 and FIG. 5. Each pile of the plurality of piles is of a predefined size (i.e. having a predefined length, width and height) and having a predefined volume of material (i.e. threshold volume 150). Further, each pile of the plurality of piles is configured to occupy a predefined deposit-area 142 on the working surface 124 of the worksite 100. The information pertaining to the predefined deposit-area 142 and the threshold volume of material in the pile may be pre-stored within the memory 134 (as illustrated in FIG. 2). In the illustrations the deposit-area 142 has been illustrated by a linear dimension. However, it may be visualized that the linear dimension may extend orthogonally into the plane of the paper by a pre-defined distance to form the deposit-area 142.

The operation of the one or more machines 102 via the control system 108 and/or the material depositing module 130 will now be explained in detail with reference to an exemplary embodiment as illustrated in FIG. 3-11. Referring to FIG. 3 and FIG. 4, the controller 132 commences operation of the machine 102 by generating an operation signal to activate the machine 102. Upon activation, the machine 102 instructs the work implement 104 to engage with the working surface 124. The machine 102 then moves towards the deposit-area 142 to collect the threshold volume 150 of material in the work implement 104. The threshold volume of material 150 within the work implement 104 is then deposited on the deposit-area 142 to form a pile P1 having a predefined height 'H'. The process is repeated to form plurality of piles i.e. P2 and P3 on the working surface 124 of the worksite 100, adjacent to pile P1, as shown in FIG. 5. The piles P2 and P3 are formed such that they are similar to pile P1 i.e. the P1, P2 and P3 have same height 'H', have same amount of material i.e. threshold volume 150 of material and occupy the same predefined deposit-area 142 on the worksite 100.

The process of operating the machine 102 is to be repeated to form (n>=1) number of piles (of same length, width and height and having the same volume of material as of P1, P2 and P3 and being equally spaced apart) subsequent to formation of the piles P1, P2 and P3. However, due to unavoidable factors such as depressions on the work surface, shedding of material during operation, etc., the machine 102 may form piles of unequal sizes (for example piles having unequal height) deposited in each of the deposit-area 142. Compaction of such piles of unequal sizes (having unequal height) may produce an uneven surface. The material depositing module 130 of the present disclosure obviates the production of an uneven surface by adjusting area to be taken by the pile depending on the volume of the material transported by the machine 102.

The detailed explanation of how the controller 132, of the material depositing module 130, obviates the production of an uneven surface by adjusting area to be taken by a pile depending on the volume of the material transported by the machine 102 will now be explained in detail. During operation of the machine 102 on the worksite 100, the controller 132 of the material depositing module 130 is configured to receive machine signals from the one or more machine sensors i.e. the engine sensor 118 and the slip sensor 119. Based on the machine signals, the controller 132 of the material depositing module 130 is configured to determine a volume of material transported by the machine 102.

For the sake of better understanding, the step of determining the volume of material transported by the machine 102 will now be explained in detail with reference to an example. The machine 102 may produce torque T1 to move on the working surface 124 of the worksite 100 at a specific speed under no load conditions (i.e. when the machine 102 is not transporting/collecting material). Such information may already be pre-stored in the memory 134. Now, when the machine 102 is operating at the worksite 100 to transport material to form pile at the deposit-area 142 a torque T2 may be generated to move the machine 102.

The controller 132 receives the torque value T2 from the engine sensor 118 and compares it with the torque value T1. The controller 132 deduces that the value T2 is greater than the value T1 as T2 is the torque value when the machine 102 is working in a loaded condition (i.e. transporting material). The controller 132 computes the difference between T2 and T1 and applies a set of algorithms/computations (stored in the memory 134) on the difference between T2 and T1 to determine the amount of material that is being transported by the machine 102.

Figure 6:
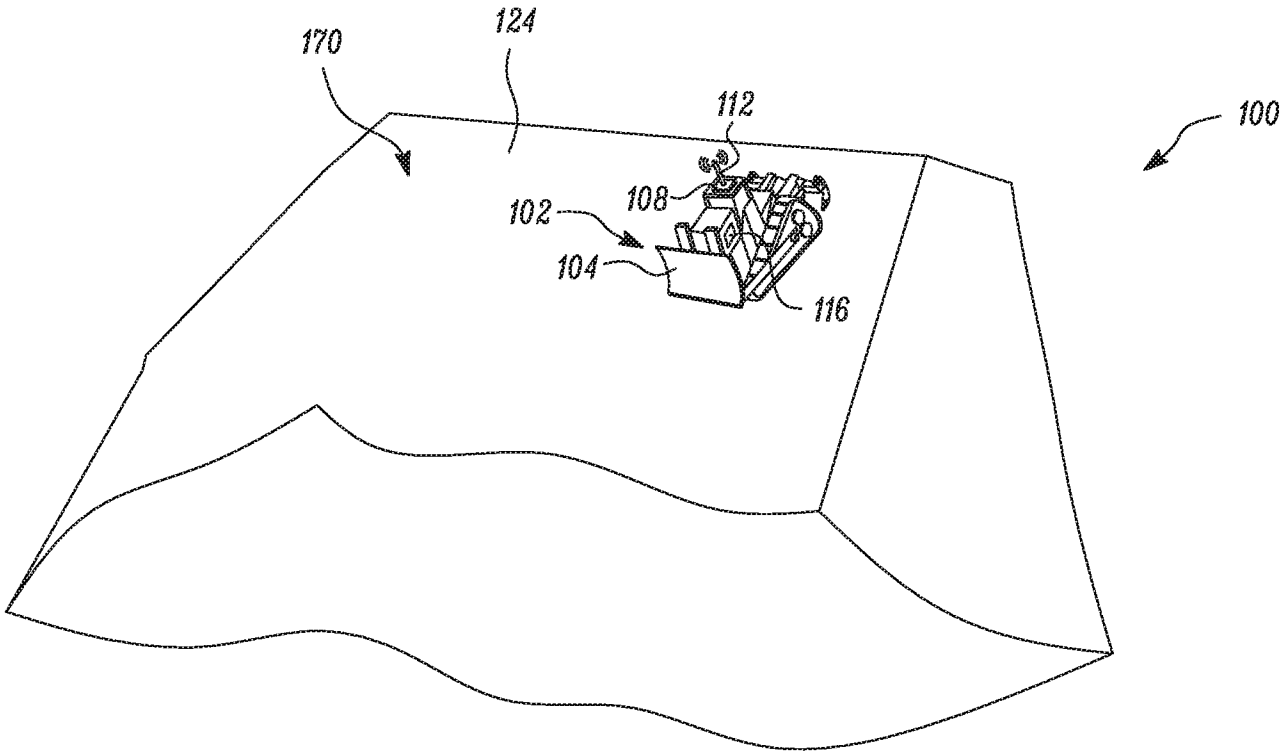
FIG. 6 illustrates a terrain of the worksite before operation of the machine to collect material within the work implement, in accordance with an embodiment of the present disclosure.
Figure 7:
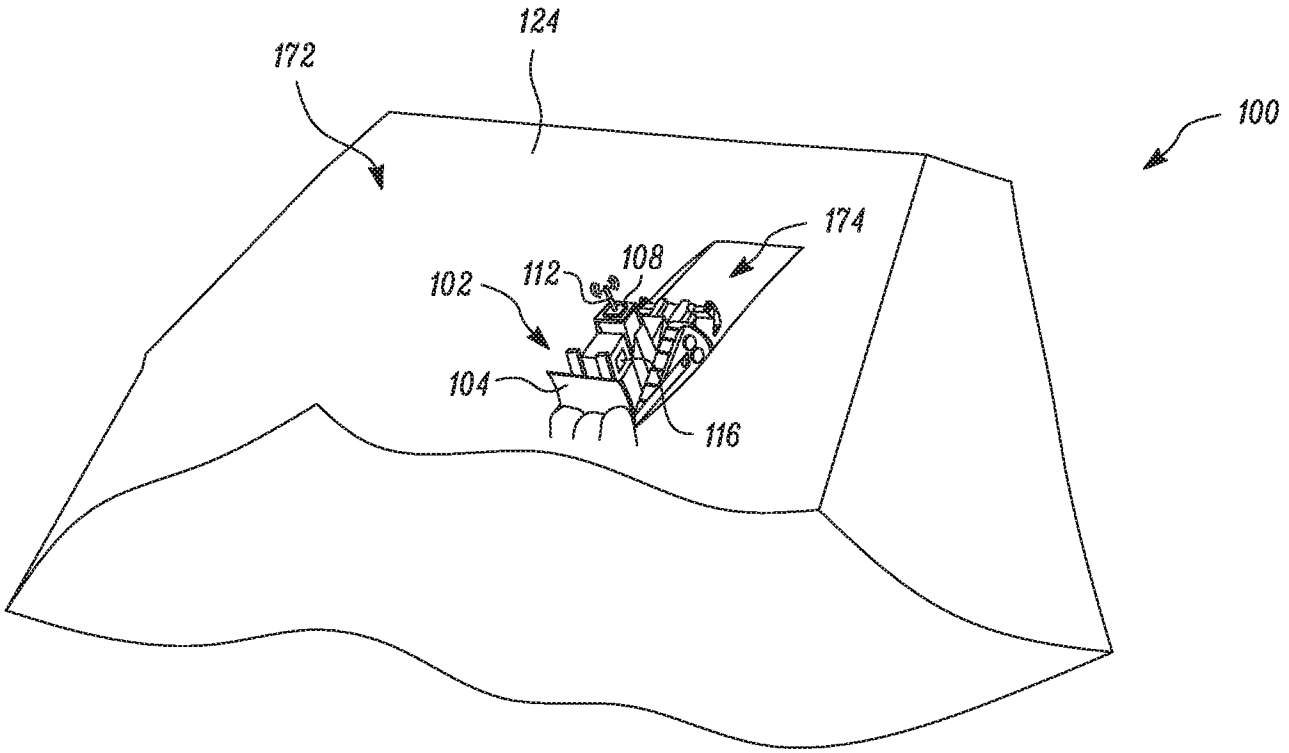
FIG. 7 illustrates a terrain of the worksite after a start of operation of the machine to collect material within the work implement, in accordance with an embodiment of the present disclosure.

In an alternate embodiment, the volume of material transported by the machine 102 may be determined by monitoring the terrain of the worksite 100 i.e. the working surface 124 before the material is collected in the work implement 104 and after the material has been deposited on the working surface 124, as illustrated in FIG. 6 and FIG. 7. For example, the control system 108 and/or the material depositing module 130 may receive the perception data from the perception module 128 before and after operation of the machine 102 to form the pile. Based on the perception data, the control system 108 and/or the material depositing module 130 determine the terrain features on the working surface 124. For the purpose of better understanding, it is assumed that the working surface 124 has a terrain 170 before operation of the machine 102 to collect material in the work implement 104. Further, it is assumed that the working surface 124 has a terrain 172 after the machine 102 has collected material in the work implement 104. The controller 132 receives information pertaining to the terrain 170 and 172. The controller 132 now compares the terrain 172 with the terrain 170. Based on this comparison, the controller 132 determines that a cut has been made on the terrain 170 by the work implement 104 (the cut being illustrated by reference numeral 174 in the terrain 172). The controller 132 concludes that the cut 174 was made when the work implement 104 engaged with the terrain 170, during machine operation, to collect material therein. The controller 132 concludes that the cut 174 has a volume which is equal to the volume collected in the work implement 104. The controller 132 then calculates the volume of the cut 174 based on the comparison of the terrain 170 and 172. The calculated volume of the cut 174 is then stored in the memory 134 as the volume collected in the work implement 104.

The controller 132 then compares the determined volume of material with the threshold volume 150. If the determined volume of material is equal to the threshold volume 150, the controller 132 determines that the determined volume is to be deposited on the deposit-area 142 to form pile such as pile P1/P2/P3, as shown in FIG. 5.

Figure 9:
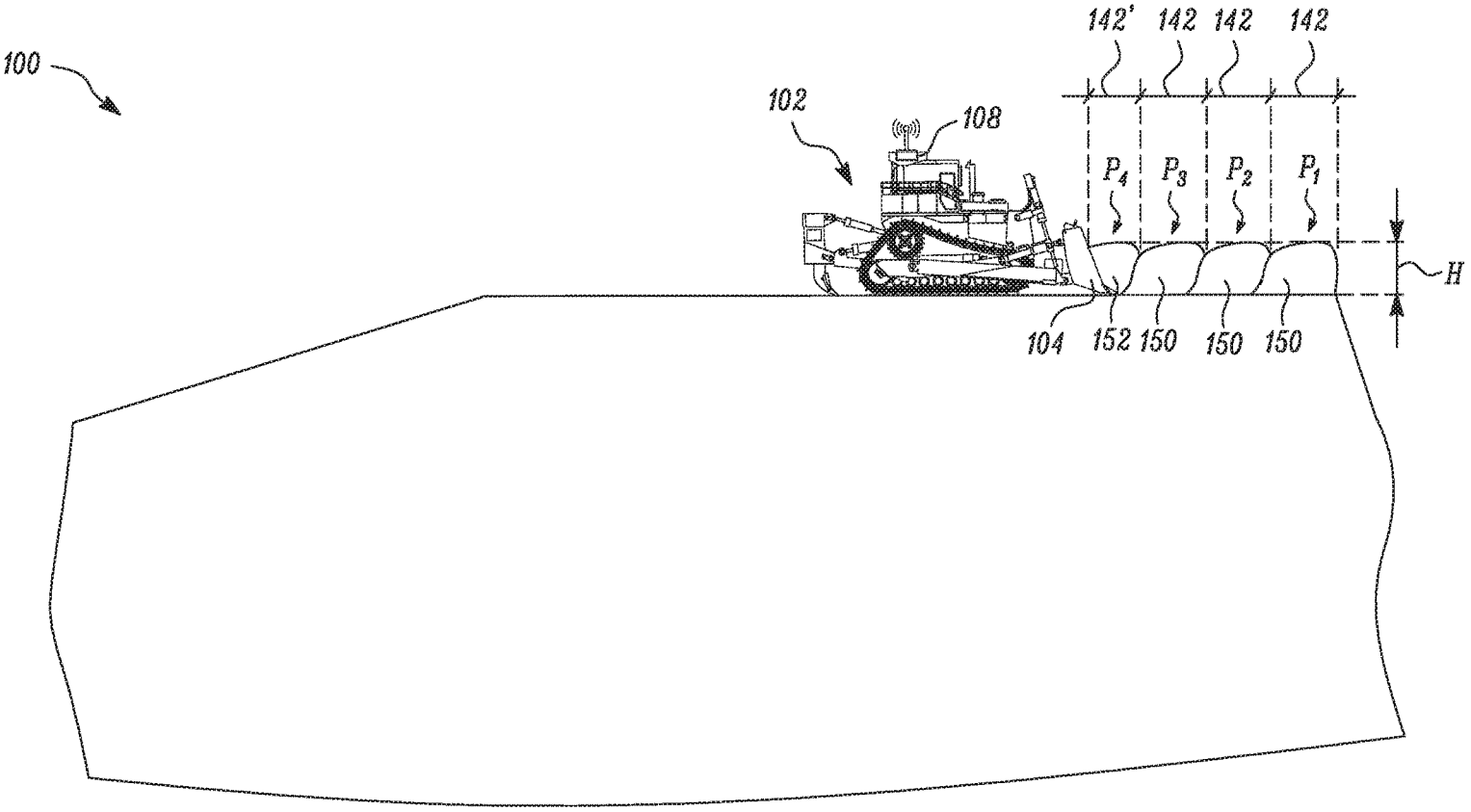
FIG. 9 illustrates the machine depositing the volume of material less than the threshold volume of material to form pile, in accordance with an embodiment of the present disclosure.
Figure 11:
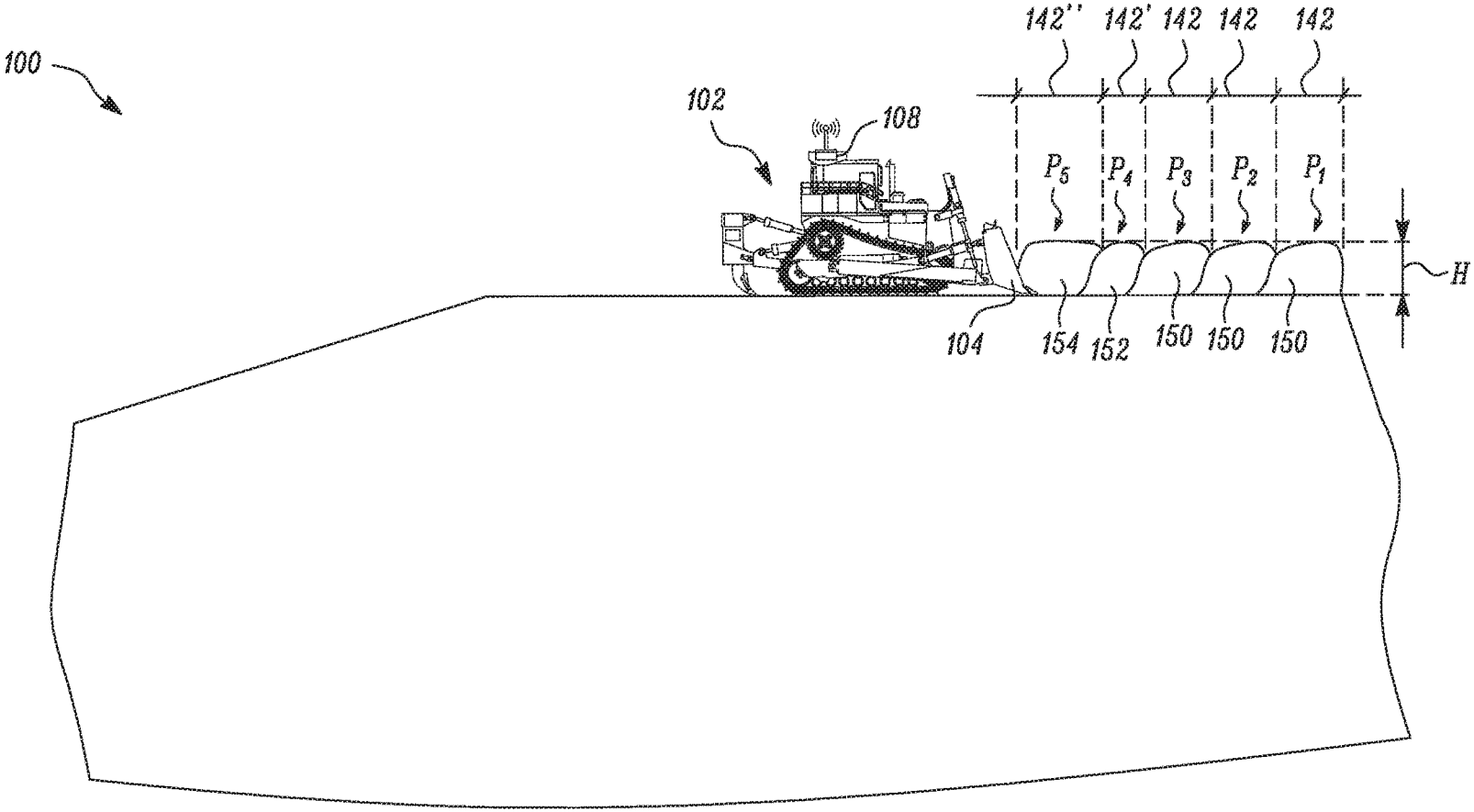
FIG. 11 illustrates the machine depositing the volume of material greater than the threshold volume of material to form pile, in accordance with an embodiment of the present disclosure.

In case the determined volume of material is not equal to the threshold volume 150, the controller 132 determines at least one parameter associated with the pile to be formed by the determined volume. The at least one parameter is determined such that the pile to be formed by the determined volume has a height that is equal to the height 'H' of the pile P1/P2/P3 (the height 'H' being the height of a pile formed when the threshold volume 150 is deposited on the deposit-area 142), as illustrated in FIG. 9 and FIG. 11.

The at least one parameter associated with the pile to be formed by the determined volume may correspond to the dimensions of the pile to be formed, by the determined volume of material, on the working surface 124. For example, the at least one parameter may correspond to the area occupied on the working surface 124 when the determined volume of material is deposited to form the pile having the height 'H'. In an alternate example, the at least one parameter may correspond to one or more of length and width of the pile that is formed when the determined volume of material is deposited on the working surface 124 to form the pile having height 'H'. The controller 132 then operates the machine 102 to deposit the determined volume based on the at least one parameter to form the pile having height 'H'.

Figure 8:
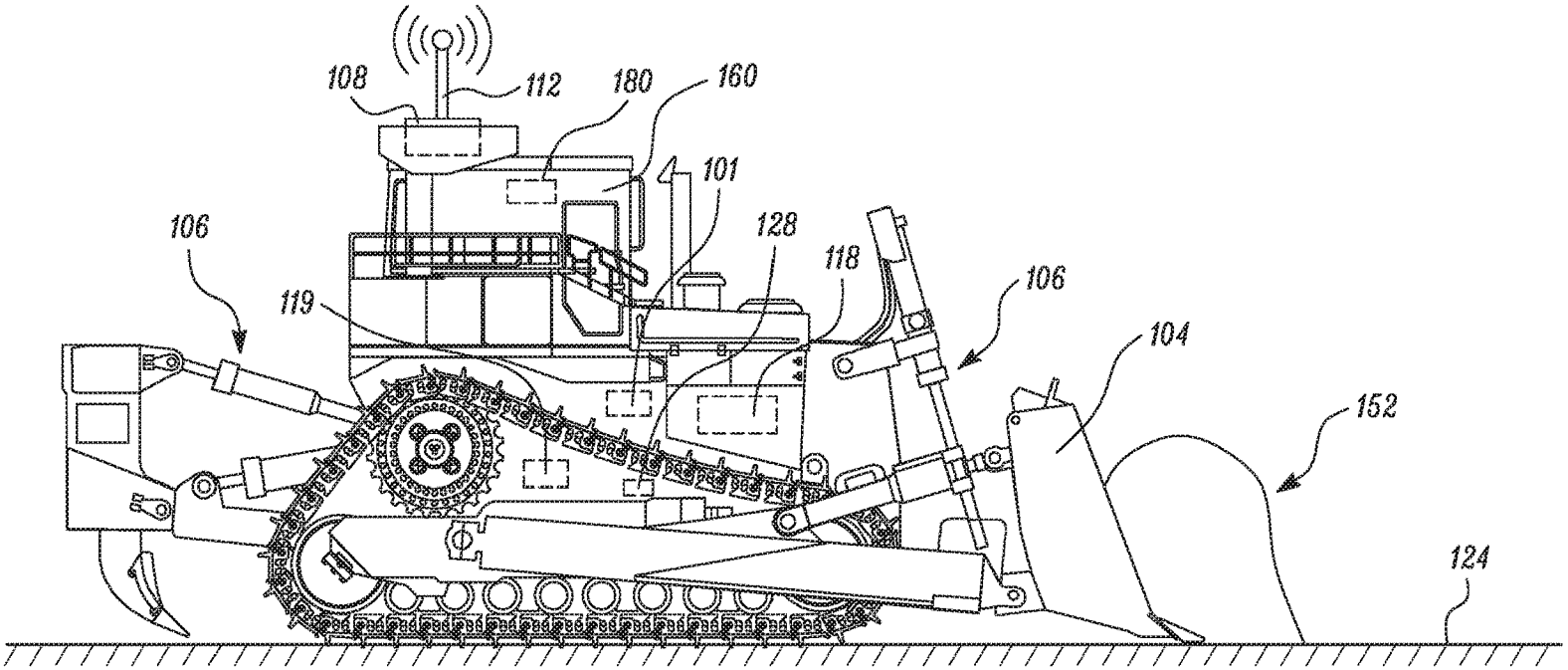
FIG. 8 illustrates the work implement of the machine transporting a volume of material less than the threshold volume of material, in accordance with an embodiment of the present disclosure.

For the purpose of better understanding the above-mentioned operation of the controller 132, will now be explained with reference to an example, illustrated in FIG. 8-9. It is assumed that for the piles P1, P2 and P3 (ideal sized piles i.e. having threshold volume 150 and occupying the deposit-area 142), the threshold volume 150 is 1000 m3 and the deposit-area 142 is 100 m2. Lets further assume that the deposit-area 142 has a length and width of 10 m. Thus, the height 'H' of the pile formed when the threshold volume 150 is deposited on the deposit-area 142 comes out to be 10 m.

During operation of the machine 102 to form piles, the controller 132 detects/determines the volume of material transported by the machine 102 by using the techniques as discussed above. The determined volume of material in the work implement 104 of the machine 102, as illustrated in FIG. 8 and FIG. 9 shall hereinafter be referred to by reference numeral 152. For the purpose of ongoing disclosure, it is assumed that the determined volume of material 152 comes out to be 800 m3.

On comparing the determined volume of material 152 with the threshold volume 150, the controller 132 determines that the determined volume of material 152 is 0.8 times the threshold volume 150. The controller 132 designates the determined 0.8 value as a pile depositing factor. The pile depositing factor is a numerical value, which is used to compute certain variables during machine operation. Based on this pile depositing factor 0.8, the controller 132 determines at least one parameter i.e. one or more of the length and width of the pile to be formed by the volume of material 152 such that the height of the pile 'P4' to be formed by the volume of material 152 is same as the height 'H' of the piles P1, P2 and P3.

For example, the controller 132 calculates a new deposit area 142' for the pile to be formed by the determined volume of material 152 by multiplying the pile depositing factor of 0.8 to the magnitude of the deposit-area 142. Thus, the new deposit area 142' comes out to be 80 m2. Based on the new deposit area 142', the controller 132 determines the at least one parameter i.e. a length or/and a width of the new deposit area 142'. For example, the controller 132 may determine the length of the new deposit area 142' as 10 m or the width of the new deposit area 142' as 8 m. In an alternate example, the controller 132 may determine the width of the new deposit area 142' as 10 m and the length of the new deposit area 142' as 8 m. In various other embodiments, the controller 132 may determine different values for the length and width of the new deposit area 142'.

Subsequent to determination of the at least one parameter, the controller 132 generates a signal to operate the machine 102 and deposit the determined volume of material 152 on the new deposit area 142'. Thus, when the machine 102 deposits the determined volume of material 152 i.e. 800 m3 on the new deposit area 142' having area of 80 m2, a pile P4 is formed having a height 'H' of 10 m. Thus, the height of the pile P4 comes out to be of the same value as of the ideal pile size P1, P2 and P3. Thus, upon compaction of piles P1, P2, P3 and P4 a smooth surface is produced.

Figure 10:
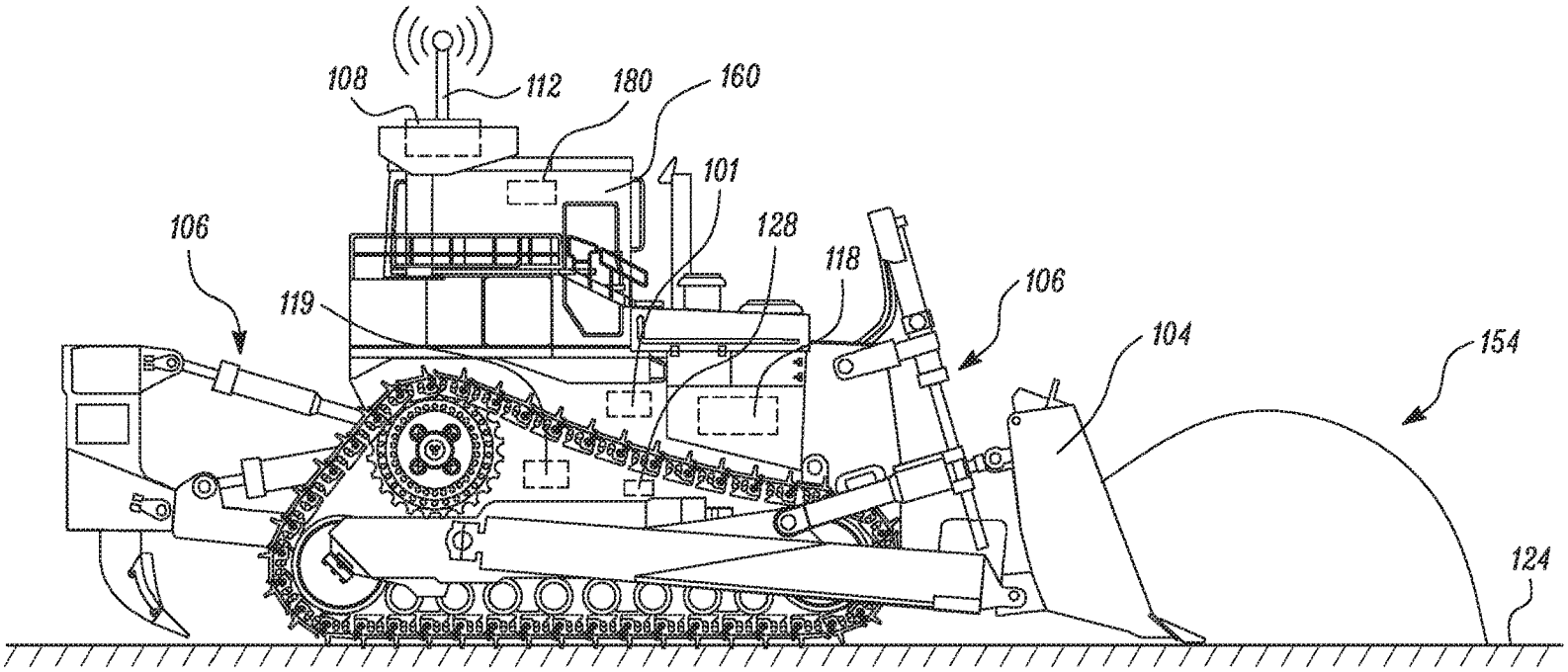
FIG. 10 illustrates the work implement of the machine transporting a volume material greater than the threshold volume of material, in accordance with an embodiment of the present disclosure.

The functioning of the controller 132 of the material depositing module 130 shall be illustrated again with reference to an alternate example as illustrated in FIG. 10-11. Lets again assume that the threshold volume 150 is 1000 m3 and the deposit-area 142 being 100 m2 wherein magnitude of length and width of the deposit-area 142 is 10 m. Thus, the height 'H' of the pile formed when the threshold volume 150 is deposited on the deposit-area 142 comes out to be 10 m.

During operation of the machine 102 to form piles, the controller 132 detects/determines the volume of material transported by the machine 102 by using torque comparison technique as discussed above. The determined volume of material in the work implement 104 of the machine 102, as illustrated in FIG. 10 and FIG. 11 shall hereinafter be referred to by reference numeral 154. Lets assume that the determined volume of material 154 comes out to be 1200 m3.

On comparing the volume of material 154 with the threshold volume 150, the controller 132 determines that the volume of material 154 is 1.2 times the threshold volume 150. The controller 132 designates the determined 1.2 value as the pile depositing factor. Based on this pile depositing factor of magnitude 1.2, the controller 132 determines at least one parameter i.e. one or more of the length and/or width of the pile to be formed by the volume of material 154 such that the height of the pile to be formed by the volume of material 154 is also 'H'.

For example, the controller 132 calculates new deposit area 142" for the pile to be formed by the determined volume of material 154 by multiplying the pile depositing factor of 1.2 to the magnitude of the deposit-area 142. Thus, the new deposit-area 142" comes out to be 120 m2. Based on the new deposit area 142", the controller 132 determines the at least one parameter i.e. a length and width of the new deposit area 142". For example, the controller 132 may determine the length of the new deposit area 142" as 10 m and the width of the new deposit area 142" as 12 m.

The controller 132 may then generate a signal to operate the machine 102 and deposit the determined volume of material 154 on the new deposit area 142". Thus, when the machine 102 deposits the determined volume of material 154 i.e. 1200 m3 on the new deposit area 142" having area of 120 m2, a pile P5 is formed having a height 'H' of 10 m. Thus, the height of the pile P5 comes out to be of the same value as of the ideal sized pile P1, P2 and P3 (having a threshold volume of material). Thus, upon compaction of piles P1, P2, P3, P4 and P5 a smooth surface is produced.

In the embodiment illustrated, the material depositing factor associated with the pile to be formed by the determined volume may be any value ranging from zero to infinity. However, in an alternate embodiment, an upper bound value and a lower bound value may be set for the material depositing factor. For example, an operator may define the upper bound value as 1.1. In the example illustrated in FIG. 10 and FIG. 11, the determined volume of material 154 is compared with the threshold volume 150 to determine the material depositing factor as 1.2 (as the determined volume of material 154 is 1.2 times the magnitude of the threshold volume 150). This value of 1.2 is compared to the upper bound value 1.1 by the controller 132. The controller 132 determines the material depositing factor of 1.2 to be greater than 1.1. In such a scenario when the material depositing factor is greater than the upper bound value the controller 132 updates the material depositing factor by setting the upper bound value as the material depositing factor. The controller 132 now determines the at least one parameter to be associated with the pile based on the pile depositing factor of 1.1 (i.e. the upper bound value).

In a similar manner, the lower bound value may be set for the material depositing factor. The controller 132 may determine the material depositing factor to be less than the lower bound value. In such a scenario when the material depositing factor is less than the lower bound value the controller 132 updates the material depositing factor by setting the lower bound value as the material depositing factor. The controller 132 now determines the at least one parameter to be associated with the pile based on the upper bound value.

In the embodiment illustrated, the threshold volume 150 is a predefined value stored in the memory 134. However, in an alternate embodiment, an operator present in the operator cabin 160 may input a magnitude of the threshold volume 150 via an input device 180 present in the operator cabin 160, as illustrated in FIG. 3. In yet another embodiment, the threshold volume 150 may be input by the operator at the command center 120. In yet another embodiment, operator may input the value of the threshold volume 150 via the computing device 122. In a similar manner, the upper bound value and the lower bound value may be input by an operator via one of the input device 180, the command center 120 and the computing device 122.

INDUSTRIAL APPLICABILITY

Dozer machines may be configured to push material and form piles at a location on the worksite. It may be desired to have a certain number of piles, which are substantially of equal size (for example, same height) to be positioned at regular intervals along a defined distance. However, in operation the dozer may not form piles of equal sizes due to variables such as depressions on the work surface, shedding of material, etc. Compaction of such piles of varying size may form an uneven surface.

Figure 12:
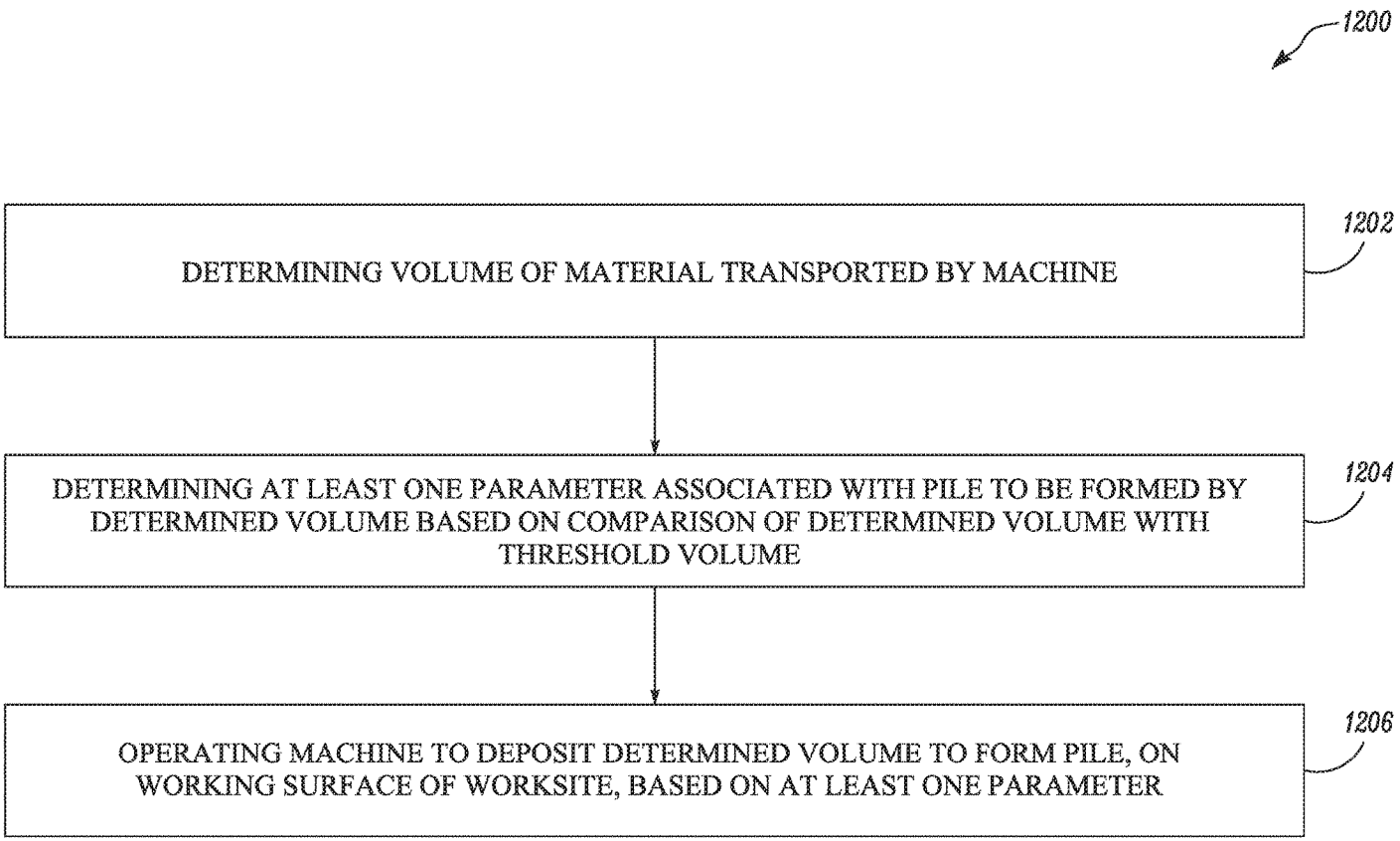
FIG. 12 depicts a method of operating the machine at the worksite in accordance with an embodiment of the present disclosure.

The present disclosure discloses a method 1200 for depositing pile of material by the machine 102 at the worksite 100, as illustrated in FIG. 12. The machine 102 includes the material depositing module 130 having the controller 132. The controller 132 determines a volume of material transported by the machine 102 based on the one or more machine signals received by the one or more machine sensors (Step 1202).

The controller 132 compares the determined volume with the threshold volume 150. Based on this comparison, the controller 132 determines at least one parameter associated with the pile to be formed by the determined volume (Step 1204). The at least one parameter corresponds to the dimensional parameters of the pile to be formed by the determined volume of material. For example, the controller 132 determines at least one parameter (i.e. the dimensional parameters) associated with the pile to be formed by the determined volume of material 152, based on a comparison of the determined volume with the threshold volume 150, such that the pile to be formed by the determined volume of material 152 has height that is equal to the height 'H' of the pile P1/P2/P3 (pile P1/P2/P3 having the threshold volume 150 deposited on the deposit-area 142). The controller 132 then operates the machine 102 to form the pile, on the working surface 124 of the worksite 100, based on the at least one parameter such that the pile has height 'H' as desired (Step 1206).

Using the method 1200 the operator in the worksite 100 or at the command center 120 can form multiple piles on the working surface 124 wherein each pile deposited on the worksite 100 is such that the volume of material in the pile is proportional to the area occupied by the pile on the working surface 124 of the worksite 100. In an alternate embodiment, the method 1200 may be used to form multiple piles wherein each pile has a height 'H' although the piles may have different volume of material therein. Compaction of such piles of equal height produces a smooth surface which is required for the machine 102 to perform its operation in an optimal manner. Further, implementation of this method 1200 using the material depositing module 130 of the present disclosure, automates the process of forming piles of material on the worksite 100. Such an automated process reduces the time spent by the operator to operate the machine 102 to achieve the desired result. The time saved by the operator, due to automation of the process, may be used in other aspects of the operation to improve productivity.

While aspects of the present disclosure have been particularly shown and described with reference to the embodiments above, it will be understood by those skilled in the art that various additional embodiments may be contemplated by the modification of the disclosed machines, systems and methods without departing from the spirit and scope of what is disclosed. Such embodiments should be understood to fall within the scope of the present disclosure as determined based upon the claims and any equivalents thereof.

What is claimed is:

1. A method for depositing a pile of material along a path by a machine at a worksite, the method comprising:

(a) storing a threshold volume of material to be moved along the path by a ground engaging work implement of the machine;

(b) storing a threshold pile length measured along the path;

(c) determining, by a controller, a transported volume of material transported by the ground engaging work implement of the machine along the path;

(d) determining, by the controller, a pile depositing factor based upon a difference between the threshold volume of material and the transported volume of material, the pile depositing factor being a ratio between the threshold volume of material and the transported volume of material;

(e) determining, by the controller, at least one parameter associated with the pile as a function of the threshold pile length and the pile depositing factor, the at least one parameter being a pile length along the path of the pile to be formed; and (f) operating, by the controller, the machine to deposit the determined volume to form the pile, on a working surface of the worksite, based on the at least one parameter.

2. The method of claim 1, wherein determining the transported volume of material transported by the machine comprises:

receiving at least one machine signal from one or more machine sensors; and calculating the transported volume of material transported by the machine based on the at least one machine signal.

3. The method of claim 2, wherein the at least one machine signal includes information pertaining to one or more of:

torque generated by an engine of the machine; and a slip factor of the machine.

4. The method of claim 1, wherein the pile length corresponds to the threshold pile length times the pile depositing factor.

5. The method of claim 1, wherein determining the transported volume of material transported by the machine comprises:

determining an initial terrain along the path prior to a material moving operation;

determining a subsequent terrain along the path after the material moving operation; and determining the transported volume of material based upon a difference between the initial terrain and the subsequent terrain.

6. The method of claim 1, further comprising:

storing an upper bound value for the material depositing factor;

repeating steps (c)-(f); and upon determining, by the controller, a pile depositing factor that exceeds the upper bound value, utilizing the upper bound value to determine, by the controller, the at least one parameter associated with the pile as a function of the threshold pile length and the upper bound value.

7. The method of claim 1, further including repeating steps (c)-(f) until a desired amount of material has been moved.

8. A material depositing system for a machine operating at a worksite, the material depositing system comprising:

a ground engaging work implement of the machine configured for moving material along a path at the worksite;

a controller operatively coupled to the machine, the controller configured to:

(a) store a threshold volume of material to be moved by the work implement;

(b) store a threshold pile length measured along the path;

(c) determine a transported volume of material transported by the ground engaging work implement of the machine along the path;

(d) determine a pile depositing factor based upon a difference between the threshold volume of material and the transported volume of material, the pile depositing factor being a ratio between the threshold volume of material and the transported volume of material;

(e) determine at least one parameter associated with a pile to be formed as a function of the threshold pile length and the pile depositing factor, the at least one parameter being a pile length along the path of the pile to be formed; and (f) operate the machine to form the pile, on a working surface of the worksite, based on the at least one parameter.

9. The material depositing module of claim 8, wherein the controller is further configured to:

receive at least one machine signal from at least one machine sensor to determine the transported volume of material transported by the machine.

10. The material depositing module of claim 9, wherein the at least one machine sensor includes a torque sensor and a slip sensor.

11. The material depositing system of claim 8, wherein the pile length corresponds to the threshold pile length times the pile depositing factor.

12. The material depositing system of claim 8, wherein the controller is further configured to:

determine an initial terrain along the path prior to a material moving operation;

determine a subsequent terrain along the path after the material moving operation; and determine the transported volume of material based upon a difference between the initial terrain and the subsequent terrain.

13. The material depositing system of claim 8, wherein the controller is further configured to:

store an upper bound value for the material depositing factor;

repeating steps (c)-(f); and upon determining a pile depositing factor that exceeds the upper bound value, utilize the upper bound value to determine the at least one parameter associated with the pile as a function of the threshold pile length and the upper bound value.

14. The material depositing system of claim 8, wherein the controller is further configured to repeat steps (c)-(f) until a desired amount of material has been moved.

15. A machine configured to operate at a worksite, the machine comprising:

a ground engaging work implement of the machine configured for moving material along a path at the worksite;

at least one machine sensor configured to generate at least one machine signal;

a controller communicably coupled to the at least one machine sensor, the controller configured to:

(a) store a threshold volume of material to be moved by the work implement;

(b) store a threshold pile length measured along the path;

(c) receive the at least one machine signal from the at least one machine sensor;

(d) determine a transported volume of material transported by the ground engaging work implement of the machine along the path based on the at least one machine signal;

(e) determine a pile depositing factor based upon a difference between the threshold volume of material and the transported volume of material, the pile depositing factor being a ratio between the threshold volume of material and the transported volume of material;

(f) determine at least one parameter associated with a pile to be formed as a function of the threshold pile length and the pile depositing factor, the at least one parameter being a pile length along the path of the pile to be formed; and (g) generate a machine operation signal to cause the machine to deposit the determined volume to form the pile on a working surface of the worksite based on the at least one parameter.

16. The machine of claim 15, wherein the at least one machine sensor includes one or more of an engine torque sensor and a slip sensor.

17. The machine of claim 15, further comprising an input device configured to allow an operator to input the threshold volume.

18. The machine of claim 15, wherein the pile length corresponds to the threshold pile length times the pile depositing factor.

19. The machine of claim 15, wherein the controller is further configured to:

determine an initial terrain along the path prior to a material moving operation;

determine a subsequent terrain along the path after the material moving operation; and determine the transported volume of material based upon a difference between the initial terrain and the subsequent terrain.

20. The machine of claim 15, wherein the controller is further configured to repeat steps (c)-(g) until a desired amount of material has been moved.

* * * * *